United States Patent [19]

Krieger

[11] Patent Number: 5,016,363

[45] Date of Patent: May 21, 1991

[54] DEVICE FOR FLOAT-CONVEYING OF WEBS OF MATERIAL

[76] Inventor: Kurt Krieger, Asternweg 47, Monchengladbach 2, Fed. Rep. of Germany, D-4050

[21] Appl. No.: 315,893

[22] PCT Filed: May 6, 1988

[86] PCT No.: PCT/DE88/00275

§ 371 Date: Feb. 16, 1989

§ 102(e) Date: Feb. 16, 1989

[87] PCT Pub. No.: WO88/08950

PCT Pub. Date: Nov. 17, 1988

[30] Foreign Application Priority Data

May 9, 1987 [DE] Fed. Rep. of Germany ..... 3715533

[51] Int. Cl.[5] ..... F26B 13/00

[52] U.S. Cl. ..... 34/156; 34/155

[58] Field of Search ..... 34/155, 156, 10, 23; 226/7

[56] References Cited

FOREIGN PATENT DOCUMENTS 1156749 12/1960 Fed. Rep. of Germany ..... 34/156

1951345 10/1969 Fed. Rep. of Germany ..... 34/156

*Primary Examiner*—Henry A. Bennet

[57] ABSTRACT

A device for acting upon and float-conveying webs of material, more particularly paper, using air or another fluid medium, inter alia, for drying the web, including a number of spaced-apart air ducts (9) on at least one side of the path of the web (B) and in the form of "nozzle chambers", each chamber having at least one nozzle region extending over the width of the web path, air outlets (D) between the nozzle chambers (9), a guide element (16) extending as far as the nozzle chambers (9) disposed between each pair of nozzle chambers on at least a part of the web path, and a joint or connection (18) between the guide element and the nozzle chamber (9) set back (19) relative to the side of the nozzle chamber facing the web path (E), the guide element having a closed central region (16a) and outlet orifices (17) at the sides thereof and opening into an air outlet (3).

25 Claims, 5 Drawing Sheets

FIG.8
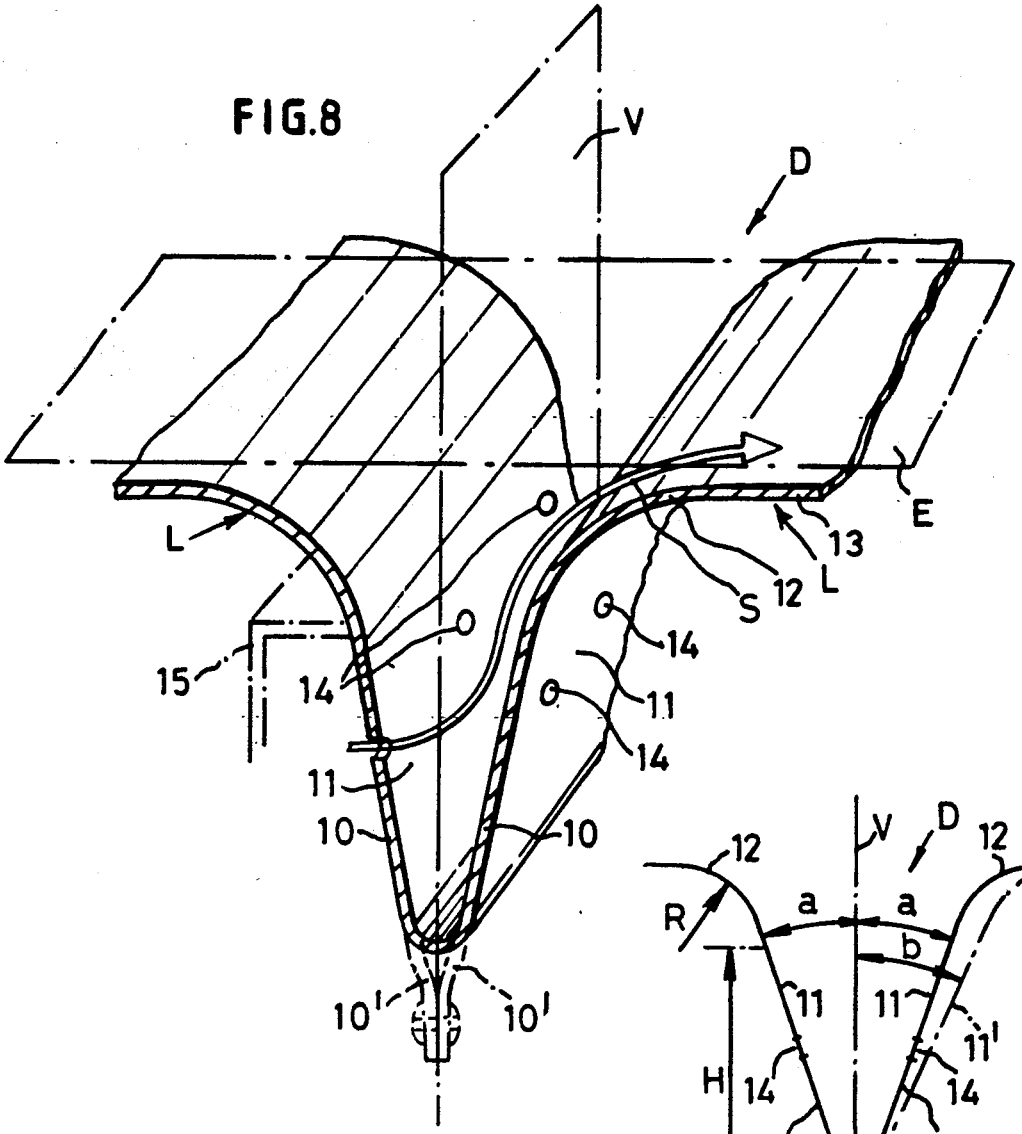
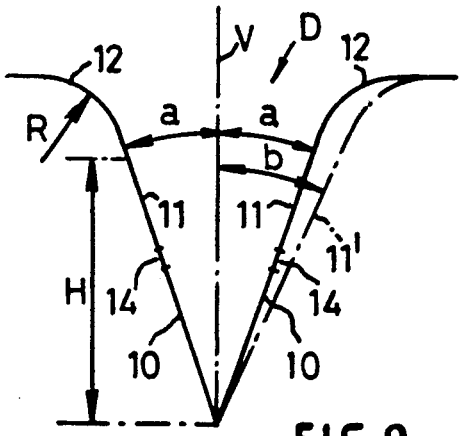
FIG.9
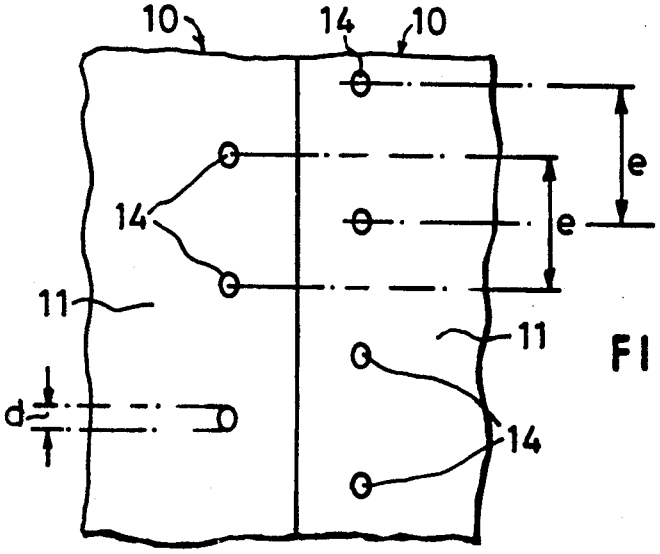
FIG.10

DEVICE FOR FLOAT-CONVEYING OF WEBS OF MATERIAL

CROSS REFERENCE TO RELATED APPLICATION(S)

This United States application stems from PCT International Application No. PCT/DE88/00275 filed May 6, 1988.

BACKGROUN OF THE INVENTION

The invention relates to a device for acting upon and float-conveying webs of material, more particularly paper webs.

In known devices in which air is blown against a moving web in order to dry it, "nozzle chambers" are present and air is discharged therefrom towards the web, normally through slot-shaped nozzles (e.g., see German Patent Reference No. DE-PS 31 30 450). The nozzle chambers are spaced apart in the direction of travel of the web, the intermediate spaces serving as air outlets. The process of conveying webs of material through such devices is beset with numerous problems. More particularly the web must be held in transit so as to avoid contact with the nozzle chambers or other parts of the device, since otherwise the web may be damaged or its surface may be adversely affected.

BRIEF SUMMARY OF THE INVENTION

An object of the invention is to take account of the existing difficulties and construct a device of the initially-mentioned kind which guide s the web in transit with particularly good efficiency and also obtains the other desired effects, i.e. dries the web or the surface thereof, in advantageous manner. The invention also aims at an advantageous construction of the device in particular. Other associated problems addressed by the invention will be clear from the following explanation Of the disclosed solution.

According to the invention, a guide element extending as far as the nozzle chambers is disposed between each pair thereof on at least part of the web path, and has a closed central area and orifices at the side thereof and opening into the air outlets; lateral areas are provided on the nozzle boxes and project beyond the adjacent parts of the guide elements in the direction towards a longitudinal plane through the web path, and the angle between the outsides of the lateral areas and the longitudinal plane is not less than 90°.

In an aforementioned device, the moving web is guided with particular efficiency and is protected from damage, and also advantageous effects are obtained. More particularly the web can be guided in corrugated manner, which is very advantageous in many cases.

The lateral areas on the nozzle chambers, which project beyond the guide elements in the direction of the plane in which the web moves, can be at an angle of up to 90° to the aforementioned plane. In a very advantageous embodiment the lateral areas are constructed so that they extend backwards like an undercut. The lateral areas are advantageously substantially planar, but a curved embodiment is not excluded.

Advantageously a well-defined edge is formed at the transition between the lateral areas of the nozzle chamber and the end face thereof. This is particularly advantageous as regards flow conditions.

The guide elements between the nozzle chambers can have various forms. Advantageously the closed central area of each guide element is made planar.

The guide element can have inclined parts, more particularly in a transition region between the central part and edge regions. Advantageously at least some of the orifices are formed in the inclined parts.

In a device of the previously-explained kind, the nozzle chambers themselves can be constructed in various ways. Particularly advantageously, individual air outlets, each opposite a respective guide surface for the air flow, are provided in the nozzle region of each nozzle chamber in the wall parts adjacent the air duct on both sides of a transverse plane in the longitudinal direction of the air duct and perpendicular to the plane in which the web moves.

The outlets can be mouthpieces, individual nozzles or the like. In a very advantageous embodiment the air outlets are holes in the wall parts of the air duct.

The nozzle chambers, including the guide elements between them, can be efficiently manufactured and operate satisfactorily even under varying conditions. Even if wall parts are slightly displaced under unfavourable conditions, the amount of air remains constant, and the flow cOnditions are also fully maintained in the desired manner.

A particularly advantageous embodiment is characterized in that two wall parts formed with outlets are disposed directly adjacent one another and each wall part at least partly constitutes a guide surface for the air flows leaving the outlets in the other wall part. This construction can give very advantageous conditions in numerous cases. More particularly it can be used to produce air flows in accordance with the "coanda" effect.

BRIEF DESCRIPTION OF THE DRAWINGS

With regard to further disclosure of the detailed features and advantages of the invention, express reference is made to the following explanation with reference to the accompanying drawings and wherein.

FIG. 8 is a greatly enlarged perspective view of part of FIG. 1

FIG. 9 is a top diagram of a nozzle region;

FIG. 10 is a plan view of part of a nozzle region;

DETAILED DESCRIPTION

Figure 1:
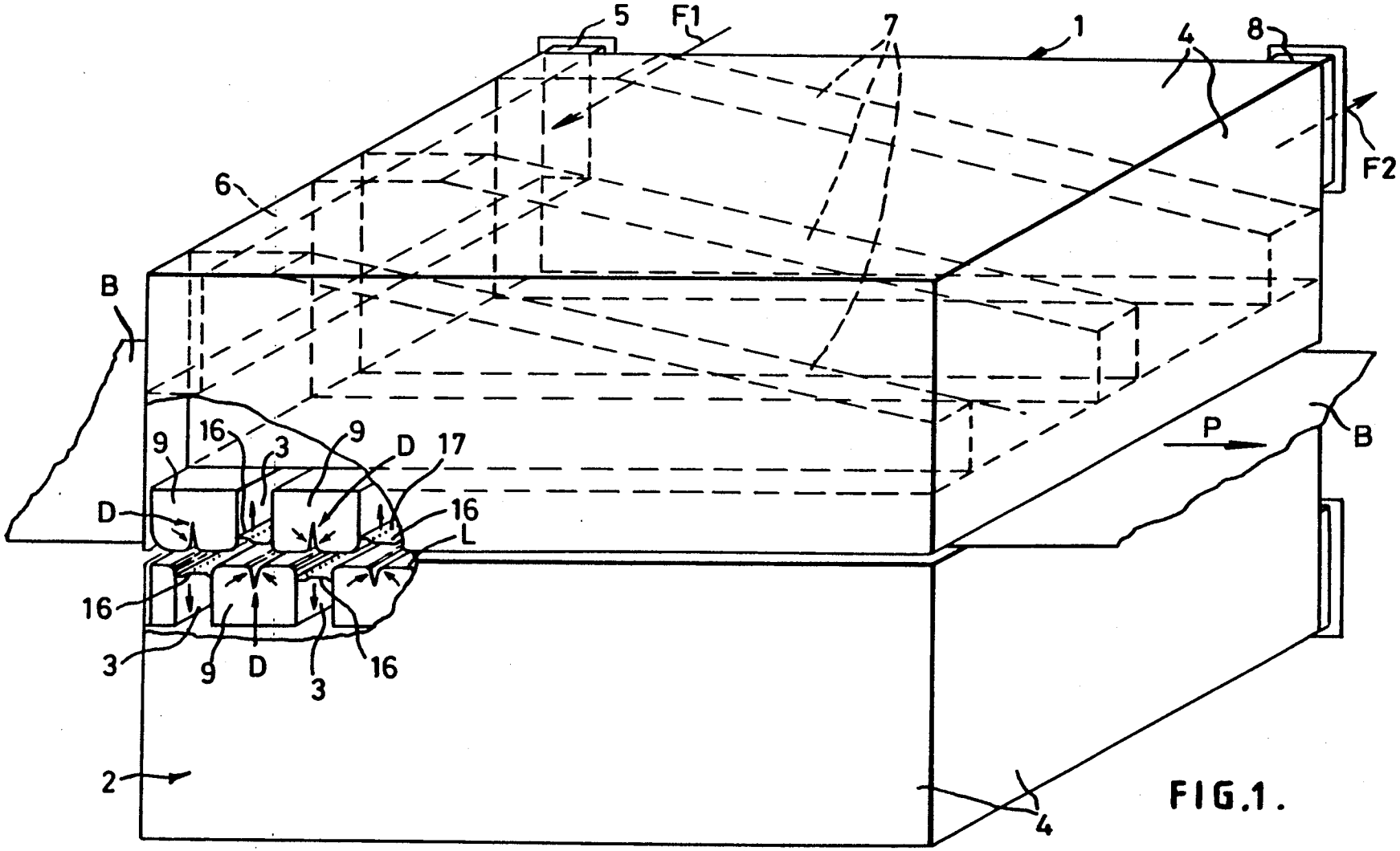
FIG. 1, is a schematic perspective view of a unit equipped with devices according to the invention for treating a moving web of material.

FIG. 1 shows a plant used e.g. for drying a paper web B which moves in a straight line in the direction of arrow P and is guided between a top unit l and a bottom unit 2. The de vices for driving the web are not shown and can be constructed in known manner. Air supply ducts in the form of "nozzle chambers" 9 are spaced apart in the longitudinal direction of the web in the bottom part of unit 1 and in the top part of unit 2, leaving spaces 3 serving as air outlets between the nozzle chambers 9 and connected to the interior of unit 1, the rest of which is enclosed by walls 4. The same applies to the nozzle chambers 9 in the bottom unit 2.

In this embodiment, the nozzle chambers 9 in the top unit 1 are offset by half a spacing from the nozzle chambers 9 in the bottom unit 2, so that a nozzle region 0 in a top nozzle chamber 9 is opposite a space between two bottom nozzle chambers 9, and vice versa. However, the structure can vary according to requirements and individual circumstances.

A guide element 16 extending up to the nozzle chambers 9 is provided between each pair thereof and is formed with orifices 17 opening into the air outlet 3. Various embodiments of such guide elements will be described in detail hereinafter.

Air at the desired temperature and pressure travels through an inlet 5 in the direction of arrow F1 into a distribution casing 6 in unit 1 and thence to a branch casing 7, connected to each nozzle chamber 9 by orifices (not shown). Corresponding remarks apply to the bottom unit 2. The air flowing from nozzle regions D travels over web 8 and through the orifice s in guide elements 16 into the air outlets 3 and thence into the aforementioned interior of unit 1, which it leaves through an outlet B. Corresponding devices for supplying and discharging to and from unit 1 can be constructed in known manner. Arrow F2 denotes the outflowing air. The bottom unit 2 is provided with means for air guidance corresponding to unit 1. Alternatively the aforementioned features can be provided on one side only.

Figure 2:
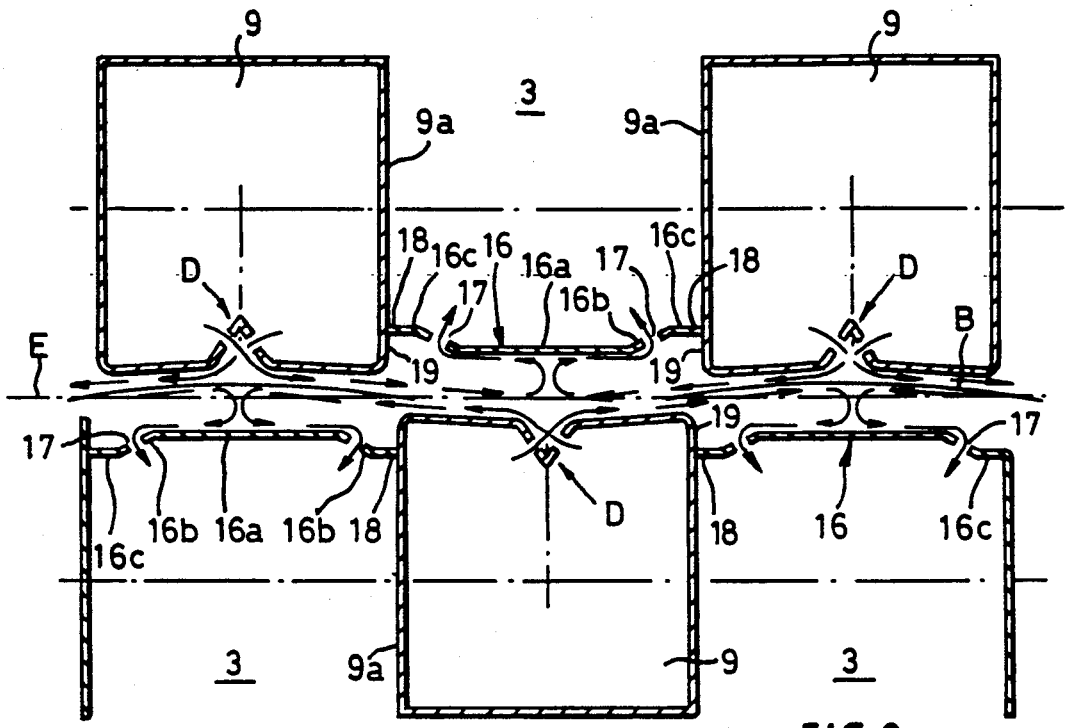
FIG. 2 is an enlarged schematic cross-sectional view of a part of FIG. 1 showing an embodiment of the device.
Figure 3:
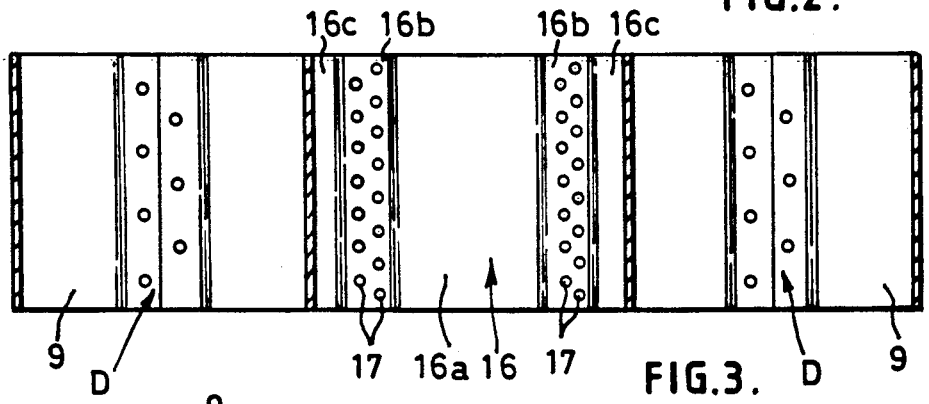
FIG. 3 is a top plan view of part of the device in FIG. 2, seen from the longitudinal plane of the web path.

FIGS. 2 and 3 show an embodiment of the device on a larger scale. Guide elements 16 are provided between each top and bottom nozzle chamber 9 and have substantially the same length as nozzle chambers 9 and, like them, extend transversely to the direction in which the web moves. Their edges abut the side walls 9*a* of nozzle chambers 9 and are connected thereto in suitable manner, depending on the material used. Advantageously the guide elements 16 and the nozzle chambers 9 are made of sheet-metal. The joints or places of transition are denoted by 18.

Each guide element 16 has a closed central region 16*a*. At the side of the central region, orifices 17 open into the air outlets 3. The orifices are advantageously disposed in mutually offset rows. Advantageously the central closed region 16*a* of guide element 16 is planar, but it can also be slightly curved if required.

On each side the central region 16*a* is adjacent bent parts 16*c* which in this embodiment are also formed with the orifices 17. The bent parts merge into edge regions 16*c* which can extend parallel to the central region 16*a* and as far as the connections 18 to the side walls 9*a* of nozzle chambers 9.

Figure 4:
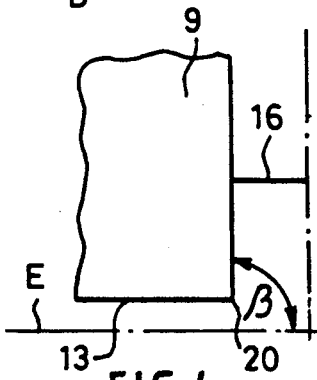
FIGS. 4 and 5 are enlarged schematic detail views show details on a larger scale.

The side walls of chambers 9 have lateral areas 19 which project beyond the guide elements 16 or beyond the connection to the edge parts 16*c* of guide elements 16 and in the direction of a longitudinal plane E through the web path. This is shown particularly clearly in FIG. 4. In this embodiment, the angle $\beta$ between the longitudinal plane E and the outer side of the laterally projecting areas 19 is about 90°.

It may be particularly advantageous with regard to flow conditions if there is a well-defined edge 20 at the transition between the lateral areas 19 and an end face 13 of nozzle chamber 9.

The nozzle regions 0 on nozzle chambers 9 can be constructed in various ways. The advantageous embodiment shown in FIGS. 2 and 6 will be described in detail hereinafter.

The air from the nozzle regions flows as shown by arrows in FIG. 2. The air flows follow parts of the end surfaces of nozzle chambers 9 in accordance with the coanda effect and travel as illustrated by arrows along guide elements 16 until the air is discharged through orifices 17 into regions 3. In the process, web B is advantageously guided without interruption and is caused to corrugate, as shown in FIG. 2.

Figure 5:
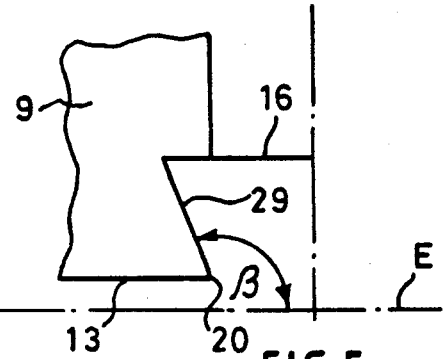
Figure 6:
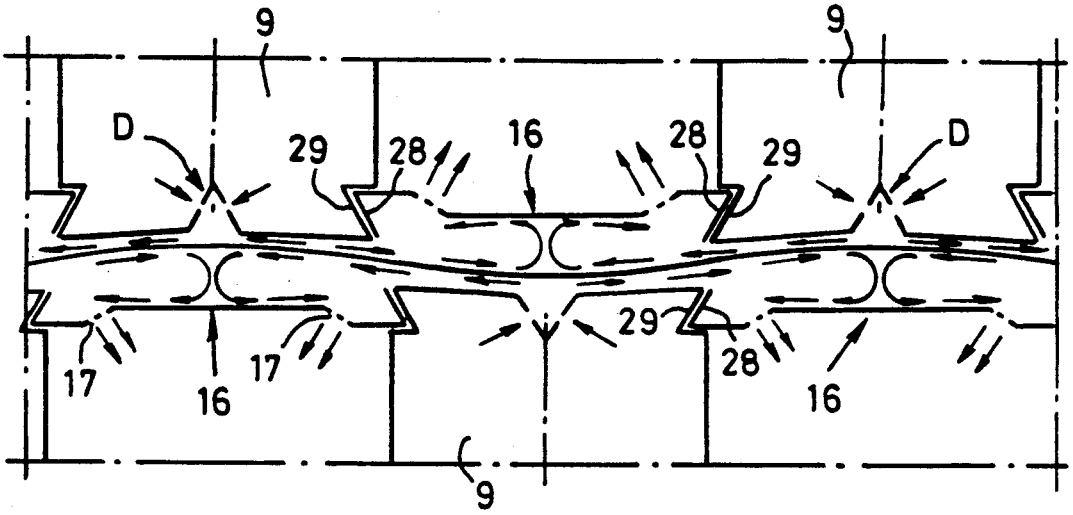
FIG. 6 is a view similar to FIG. 2 showing another embodiment of the device in FIG. 7 is a view similar to FIG. 3 of part of the device in FIG. 6.
Figure 7:
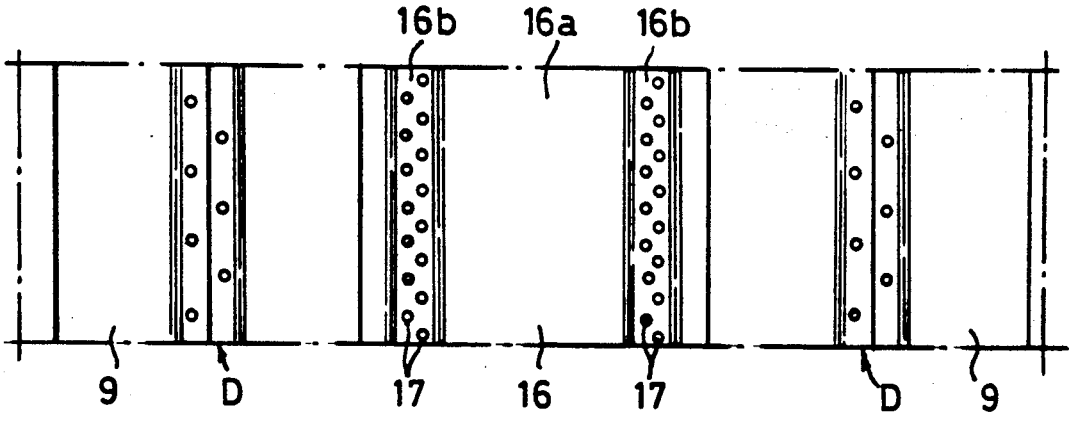

FIGS. 5 to 7 show another very advantageous embodiment. Similar or corresponding parts are given the same reference numbers as in FIGS. 2 to 4. In this embodiment the front side areas 29 of nozzle chambers 9 each extend backwards like an undercut. The angle $\beta$ between an aforementioned area 20 and the longitudinal plane E is greater than 90°, i.e. obtuse. The guide elements 16 can be connected to the side walls 9*a* of nozzle chambers 9 at places 18. Alternately, as shown in FIG. 6 they can be continued by bent areas 28 which are at the same angle as areas 29 and can be adjacent thereto or permanently connected thereto in suitable manner. In that case the outer sides of areas 28 are equivalent to the outer sides of areas 19. As before, reference 20 denotes a well-defined edge.

FIGS. 8 to 10 show an advantageous embodiment of the nozzle region D, with some modifications.

A wall 10 forming part of the boundary of an air supply duct 9 is shaped so that wall regions at an acute angle to one another merge into a respective curved part 12 adjacent plane parts 13. Parts 12 and 13 can be described as a guide surface L for an air flow.

Wall regions 10 have air outlets in the form of punched holes 14, the outlets on one side being offset relative to the outlets on the other side in the longitudinal direction of nozzle region D, i.e. transverse to the direction of the web, as shown more particularly in FIG. 10. The facing regions of walls 10 constitute baffle surfaces 11. Air flowing from holes 14 on one side strike the baffle surface 11 opposite, and vice versa. Subsequently the air flows along the curved region 12 and the adjacent region 13. In FIG. 8 this is diagrammatically indicated by line S on one side.

In the embodiment shown, the baffle surfaces 11 are each inclined at the same angle a relative to a transverse plane V perpendicular to the longitudinal plane E through the direction of travel of web B, as shown in FIG. 9. Alternatively the two baffle surfaces can be given different inclinations, depending on requirements. FIG. 9 illustrates this by means of a chain-dotted baffle surface 11', which is inclined at an angle b greater than that of the other baffle surface 11.

Advantageously the inclination is in the range from about 10° to 40°. Angles of about 15° are particularly advantageous.

In the embodiment shown in FIG. 8, all parts are im the form of a continuous wall 10, which is suitably bent in the bottom apical region. Alternatively, as shown by chain-dotted lines, the baffle surfaces 11 can be separate wall parts 10', which come together at the ends and are joined in sealing-tight manner by spot welding or another suitable method.

Advantageously a nozzle region of the aforementioned kind is disposed approximately at the center of a nozzle chamber 9 as shown in FIG. 1. In other embodiments, two such nozzle regions are spaced apart on each nozzle chamber 9.

Another possibility is to provide only one baffle surface 11 in the nozzle region, and suitable outlets will then be disposed opposite it. For example, the wall part 10 constituting the baffle surface 11 to the right in FIG. 8 can be without outlets 14, which are provided only in the wall part 10 to the left in FIG. 8. In that case no guide surface L need be provided on this side, but wall part 10 can e.g. have a bent continuation 15 constituting a normal boundary of a supply duct, as shown by chain-dotted lines in FIG. 8.

Irrespective of the details of the embodiment, the diameter d of the outlets is advantageously about 3 to 7 mm. The distances e between the outlets (FIG. 10) may more particularly be in the range from about 10 to 30 mm.

Optionally also according to the invention, more than one row of outlets 14 can be provided and/or the outlets 14 can also be vertically staggered.

The height of each wall part constituting a baffle surface 11 (FIG. 9) is advantageously in the range from H=15 mm to H=30 mm, although this should not be regarded as limiting.

The radius R of the bent part 12 adJacent each baffle surface 11 is advantageously in the range from about 5 to 25 mm. Other values, however, are possible depending on circumstances.

Figure 11:
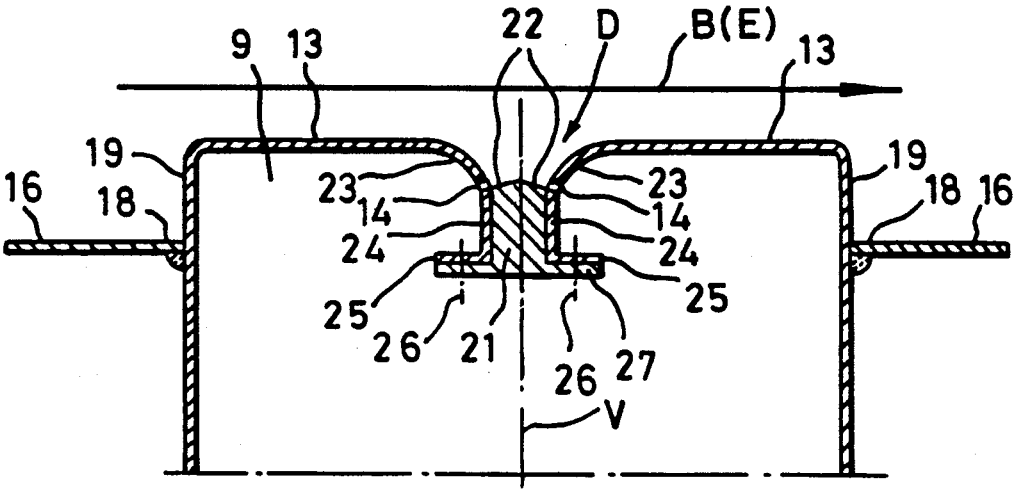
FIG. 11 is a cross-sectional view of another embodiment of a nozzle region taken through a nozzle chamber.

FIG. 11 shows an embodiment in which a closure member 21 is disposed at the base of the nozzle region D. Member 21 extends over the entire width of air duct 9 and, on its side facing the plane in which web B moves, has guide surfaces 22 which in this embodiment are roof-shaped. Air outlets in the form of bores 14 are formed in curved wall parts 23 in the immediate neighborhood of guide surfaces 22, which bound the closure member 21. The air flowing from bores 14 travels along the associated guide surface 22 and then strikes the curved wall area 23, where the coanda effect is operative as in the embodiment in FIG. 8, so that the air flows along this wall area and along the adjacent planar wall area 13 and in the process acts upon and float-conveys the web B.

Advantageously the closure member 21 is an exchangeable unit ready for fitting. More particularly it can e.g. be a drawn sectional metal part.

A closure member of the aforementioned or similar kind can simply be inserted between two wall parts 24 of air duct 9, the wall parts bearing tightly against the closure member. The closure member can be secured e.g by screws 26, indicated by central lines only in FIG. 11, and extending through boles in flange parts 25 of air duct 9 and in flange parts 27 of closure member 21.

Figure 12:
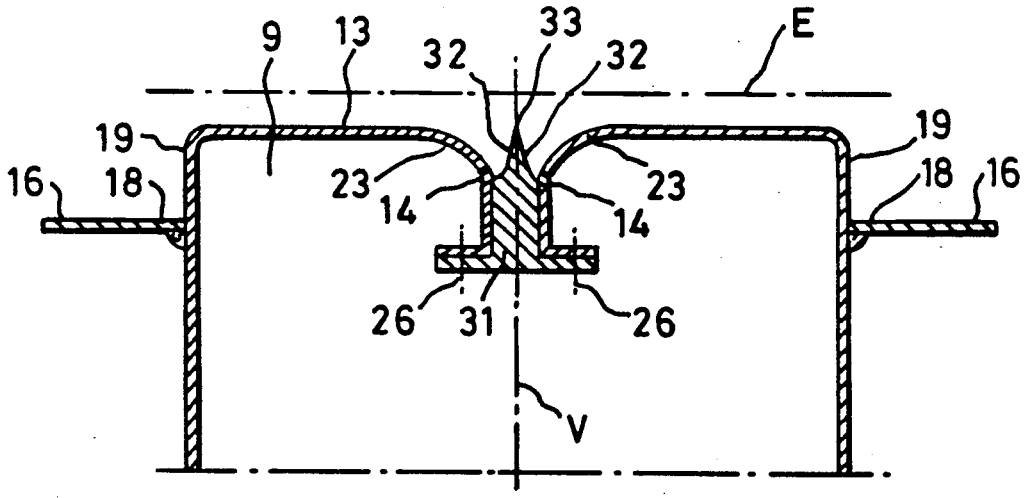
FIG. 12 another embodiment of a nozzle region.

FIG. 12 shows a closure member 31 which, like the closure member 21 in the embodiment in FIG. 11, is disposed at the base of the nozzle region D and has guide surfaces 32 on facing sides of a part 33 projecting in the transverse plane V in the direction of the plane E in which the web moves.

As before, air outlets 14 are provided in the immediate neighborhood of the beginning of the guide surfaces 32 in wall parts 23. Air flowing out of orifices 14 is guided by surfaces 32, so that the jet is deflected substantially perpendicular to the plane of motion E.

As an alternative to the embodiment in FIG. 12, the projecting part 33 of closure member 31 can lie outside the transverse plane V, more particularly at an angle thereto. Also, the two guide surfaces 32 can have different positions or inclinations relative to one another. The same applies to the guide surfaces 22 in the embodiment in FIG. 11.

Some important features of the invention will be discussed in general hereinafter, together with some special features.

The air outlets 17 in the nozzle regions or the associated wall parts can also be nozzles instead of holes. Preferably, nozzle outlets of the aforementioned kind are produced from the wall material by pressing or stamping, so as to obtain an air jet in the desired direction.

In principle, the air outlets 17 may advantageously be disposed in wall parts 10 or 23 so that the air flowing therefrom travels round the facing bent surface of nozzle chamber 9 and, if no web is present, then travels towards the orifices 17 in the guide elements 16.

More particularly, an embodiment of the aforementioned kind is present also in those end regions of the nozzle chambers D which normally lie outside the area occupied by the web. This has an advantageous lateral closure effect and also advantageously influences the stability of web motion In the embodiments in FIGS. 2, 3, and 6, 7 the orifices 17 opening into the air outlets 3 are formed in inclined parts **16*b* of guide elements 16. In another very advantageous embodiment the orifices 17 are in the edge parts 16*c*, i.e. near nozzle chambers 9. In that case the guide elements 16 have a closed central region 16*a*. The transition to the edge parts can either be an inclined surface or alternatively the cross-section at this place can be approximately arcuate or circular. As a final alternative, the guide elements 16** can be completely plane.

The closed central region **16*a* is essential, since pressure builds up here, so that the web is efficiently held and guided at this place also In the advantageous embodiment shown e.g. in FIG. 2 or FIG. 6, a nozzle region D of a nozzle chamber 9 is opposite the central region 16*a* of each guide element 16**. At this place, therefore, there is a region at a lower pressure than the region on the other side of the web. In principle, the web is guided with great stability by the alternating reduced-pressure and pressure zones in the longitudinal direction of the web. The same applies in the transverse direction of the web, so that the web is efficiently kept in position during travel and cannot move sideways.

According to the invention also, the construction of the nozzle regions can vary within a plant or treatment section, e.g. the nozzles can be as in FIG. 11 in one part of the treatment section and as in FIG. 12 in another part thereof.

All the features mentioned in the preceding description or shown in the drawing should be regarded, either alone or in combinations, as coming under the invention as far as permitted by the known prior art.

I claim:

1. A device for acting upon and float-conveying webs of material travelling in a web path using a fluid medium for drying the web, comprising:

a plurality of spaced-apart ducts for conducing the fluid medium on at least one side of the path of the web and in the form of nozzle chambers, each chamber comprising a side thereon facing the web path, and at least one nozzle region extending over the width of the web path transverse to the direction of travel of the web for directing the fluid medium toward the web path;

air outlets between said nozzle chambers;

a guide element disposed between each adjacent pair of nozzle chambers and between an adjacent air outlet and the web path and extending in the direction transverse to the direction of travel of the web substantially the same length as said nozzle chambers;

joint means between each guide element and the adjacent pair of nozzle chambers set back relative to said side of said nozzle chambers facing the web path;

a closed central region on each guide element having a width extending in the direction of travel of the web; and outlet orifices at the ends of the width of said central region, said outlet orifices being spaced in the direction of travel of the web and opening into the adjacent air outlet.

2. A device as claimed in claim 1 and further comprising:

a lateral area on each nozzle chamber adjacent each joint means projecting substantially in a plane from each joint means toward the web path at an angle of at least 90 degrees.

3. A device as claimed in claim 2 wherein said lateral areas on each nozzle chamber extend toward each other in the direction away from the web path.

4. A device as claimed in claim 2 wherein said lateral areas are substantially planar.

5. A device as claimed in claim 2 wherein a well-defined edge is provided at the transition between each lateral area and said side of each nozzle chamber facing the web path.

6. A device as claimed in claim 1, wherein said closed central area region of each guide element is substantially planar.

7. A device as claimed in claim 1 wherein each guide element has regions thereon inclined relative to the web path and at least some of said outlet orifices are formed in said inclined regions.

8. A device as claimed in claim 1 wherein said orifices comprise a plurality of rows of orifices.

9. A device as claimed in claim wherein said nozzle region comprises wall parts, individual nozzle outlets in said wall parts for fluid medium, and respective guide surface means on said wall parts, so that fluid medium from said nozzle outlets is directed substantially toward said guide surface means and substantially transversely to the web path.

10. A device as claimed in claim 9 wherein said nozzle outlets comprise holes in said wall parts.

11. A device as claimed in claim 9 wherein said wall parts comprise two wall parts formed with said nozzle outlets, and disposed adjacent one another and each wall part at least partly constitutes said guide surface means for the flow of fluid medium emitted from said nozzle outlets in the other wall part.

12. A device as claimed in claim 11 wherein said nozzle outlets in said one wall part are offset in at least one of the direction of the width of the web path and a direction substantially perpendicular to the web path direction relative to the nozzle outlets in said other wall part.

13. A device as claimed in claim 9 wherein said wall parts comprise curved portions thereon and said nozzle outlets are formed in said curve portions.

14. A device as claimed in claim 9 wherein said wall parts comprise two planar wall parts each extending at an acute angle to a plane extending transversely to the web path and each merging into curved wall areas.

15. A device as claimed in claim 14 wherein said nozzle outlets are formed in said planar wall parts.

16. A device as claimed in claim 14 wherein said planar wall parts are disposed on opposite sides of and at the same angle to said transverse plane.

17. A device as claimed in claim 9 wherein said planar wall parts are disposed at different angles to said transverse plane.

18. A device as claimed in claim 9 wherein said acute angle is in the range from about 10 degrees to about 40 degrees.

19. A device as claimed in 18 wherein said acute angle is in the range from about 14 degrees to 16 degrees.

20. A device as claimed in claim 19 wherein said wall parts are on each side of a plane extending substantially transversely to the web path and said guide surface means are provided between said nozzle outlets in the respective wall parts and face said wall parts for guiding the fluid medium from said nozzle outlets to flow in at least one of the directions substantially transversely to the web path and substantially parallel to the web path.

21. A device as claimed in claim 9 wherein said nozzle region further comprises at least one closure member extending in the direction of the width of the web path of said nozzle chamber at the base of the nozzle region remote from said web path.

22. A device as claimed in claim 21 wherein said guide surface means are formed on a surface of said closure member substantially facing the web path.

23. A device as claimed in claim 21 wherein said closure member further comprises a projecting part projecting toward the web path, and said guide surface means comprises guide surfaces on opposite sides of said projecting part of said closure member.

24. A device as claimed in claim 22 wherein said guide surface means comprises roof-shaped guide surfaces.

25. A device as claimed in claim 22 wherein said guide surface means comprises a boundary surface on said closure member and said nozzle outlets are provided immediately adjacent said boundary surface.

* * * * *